US008678217B2

(12) United States Patent
Green

(10) Patent No.: US 8,678,217 B2
(45) Date of Patent: Mar. 25, 2014

(54) ACTIVITY AND STORAGE CASE

(75) Inventor: Lisa Frank Green, Tucson, AZ (US)

(73) Assignee: Lisa Frank, Inc., Tucson, AZ (US)

( * ) Notice: Subject to any disclaimer, the term of this patent is extended or adjusted under 35 U.S.C. 154(b) by 811 days.

(21) Appl. No.: 11/193,209

(22) Filed: Jul. 29, 2005

(65) Prior Publication Data

US 2007/0026764 A1 Feb. 1, 2007

(51) Int. Cl.
*B65D 6/28* (2006.01)
*A45C 11/34* (2006.01)
*B65D 85/30* (2006.01)

(52) U.S. Cl.
USPC ..... 220/4.22; 206/214; 206/457; 312/231

(58) Field of Classification Search
USPC ..... 220/810, 4.22, 376; 224/577; 206/214, 206/461, 471, 457, 470, 775; 312/231; 24/489–571
See application file for complete search history.

(56) References Cited

U.S. PATENT DOCUMENTS

| | | | | | |
|---|---|---|---|---|---|
| 1,827,929 | A | * | 10/1931 | Bigelow | 220/523 |
| D90,930 | S | * | 10/1933 | Todd | D19/65 |
| 2,780,225 | A | * | 2/1957 | Barr et al. | 604/403 |
| 3,885,667 | A | * | 5/1975 | Spiegel et al. | 206/478 |
| 4,739,353 | A | * | 4/1988 | Heuer et al. | 206/316.2 |
| 4,896,927 | A | * | 1/1990 | Liu et al. | 312/190 |
| 4,934,304 | A | * | 6/1990 | Rosen | 116/237 |
| 5,111,918 | A | | 5/1992 | Bako et al. | 190/18 |
| 5,209,349 | A | * | 5/1993 | Porter et al. | 206/232 |
| 5,267,374 | A | * | 12/1993 | Drake | 24/30.5 R |
| 5,460,102 | A | | 10/1995 | Pasmanick | 108/43 |
| 5,551,570 | A | * | 9/1996 | Shaffer et al. | 206/575 |
| 5,671,951 | A | | 9/1997 | Palmiter et al. | 281/31 |
| 5,680,973 | A | * | 10/1997 | Vulpitta et al. | 224/153 |
| D398,650 | S | * | 9/1998 | Shamoon | D19/88 |
| 5,896,991 | A | * | 4/1999 | Hippely et al. | 206/461 |
| 6,030,274 | A | | 2/2000 | Kaplan | 446/369 |
| 6,047,820 | A | * | 4/2000 | Heinze, IIII | 206/232 |
| D428,927 | S | * | 8/2000 | Chang | D19/88 |
| 6,484,875 | B1 | * | 11/2002 | Brainerd et al. | 206/232 |
| D500,800 | S | * | 1/2005 | Shamoon | D19/88 |
| 6,846,090 | B1 | * | 1/2005 | Smith | 362/99 |
| 7,168,565 | B2 | * | 1/2007 | Scott | 206/471 |
| 2003/0038142 | A1 | * | 2/2003 | Gee | 220/835 |
| 2003/0066766 | A1 | * | 4/2003 | Lechanoine et al. | 206/216 |
| 2005/0045628 | A1 | * | 3/2005 | Chan | 220/4.22 |
| 2005/0161357 | A1 | | 7/2005 | Allan et al. | 206/373 |
| 2006/0123605 | A1 | * | 6/2006 | Adair | 24/498 |

* cited by examiner

*Primary Examiner* — Bryon Gehman
*Assistant Examiner* — Shawn Braden
(74) *Attorney, Agent, or Firm* — Hayes Soloway P.C.

(57) ABSTRACT

A child 's activity and storage case contains a top portion having a front side and a back side and a bottom portion having a front side and a back side. The back side of the bottom portion is connected to the back side of the top portion by at least one hinge. A clasp is positioned to latch the front side of the top portion to the front side of the bottom portion. A stylized clip is attached to the top portion.

13 Claims, 10 Drawing Sheets

ACTIVITY AND STORAGE CASE

FIELD OF THE INVENTION

The present invention is generally related to activity and storage cases. The activity and storage case of the present invention has particular utility as a combined storage case and clipboard for art activities for children and will be described in connection with such utility, although other utilities are contemplated.

BACKGROUND OF THE INVENTION

One regular past time for children is drawing and coloring. Drawing and coloring by children is convenient for parents, in that the activity is quiet, contained, and reasonably easy to pick up. Quiet and contained activities for children are particularly desirable while traveling. However, drawing and coloring while traveling presents problems. Drawing pads and coloring books are difficult to use when simply placed on the lap of a child. The books and pads have a tendency to bow about the legs of the child. Often books are used beneath the coloring books and drawing pads, but the restless movement of the child inhibit this makeshift solution from staying in place. Further, when the child pauses or stops coloring or drawing, the crayon or writing utensil will regularly find its way between the cushions of the seat having no better place to be stored. When flying, the crayon or writing utensil will inevitably find its way beneath the airplane seats, which may be difficult to retrieve during flight.

Thus, a heretofore unaddressed need exists in the industry to address the aforementioned deficiencies and inadequacies.

SUMMARY OF THE INVENTION

Embodiments of the present invention provide a combined activity and storage case for a child. Briefly described, in architecture, one embodiment of the case, among others, can be implemented as follows. The activity and storage case contains a top portion having a front side and a back side and a bottom portion having a front side and a back side. The back side of the bottom portion is connected to the back side of the top portion by at least one hinge. A clasp is positioned to latch the front side of the top portion to the front side of the bottom portion. A stylized clip optionally is attached to the top portion.

Other features and advantages of the present invention will be or become apparent to one with skill in the art upon examination of the following drawings and detailed description. It is intended that all such additional features and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
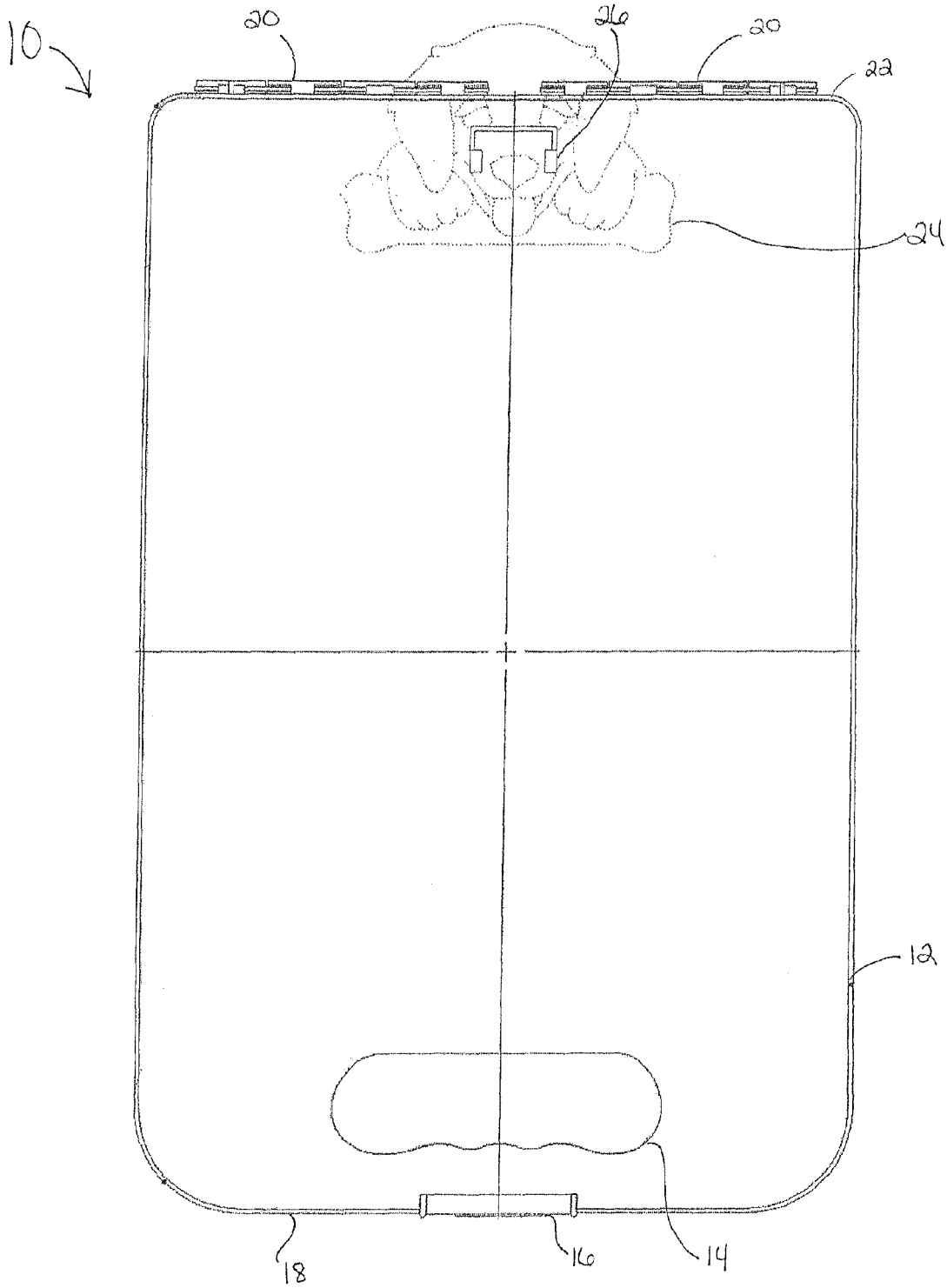
FIG. 1 is a top view of a combined activity and storage case, in accordance with a first exemplary embodiment of the present invention.

FIG. 1 is a top view of a combined activity and storage case 10, in accordance with a first exemplary embodiment of the present invention. The combined activity and storage case 10 includes a top portion 12. A handle 14 is provided for gripping and/or carrying the combined activity and storage case 10. A clasp 16 is provided for locking the combined activity and storage case 10 at a front side 18 of the top portion 12. At least one hinge 20 is provided at a back side 22 of the top portion 12 for allowing the combined activity and storage case 10 to pivotably open with relation to the bottom portion (not shown). A stylized clip 24 is attached to the top portion 12 using a clip bracket 26. The stylized clip 24 allows the top portion 12 of the combined activity and storage case 10 to operate as a clipboard. Preferably, the stylized clip 24 may be a character image attractive to a child such as of a dog holding a bone. The stylized clip 24 may also be an image of another animal, a person, or an object that a child may find attractive. As shown, the handle 14 is proximate to the front side 18, while the stylized clip 24 and clip bracket 26 are shown proximate to the back side 22. The stylized clip 24 and clip bracket 26 may also be located proximate to the handle 14 and the front side 18. Preferably, the top portion 12 may be at least partially translucent to allow viewing of the contents of the combined activity and storage case 10 without opening the case 10.

Figure 2:
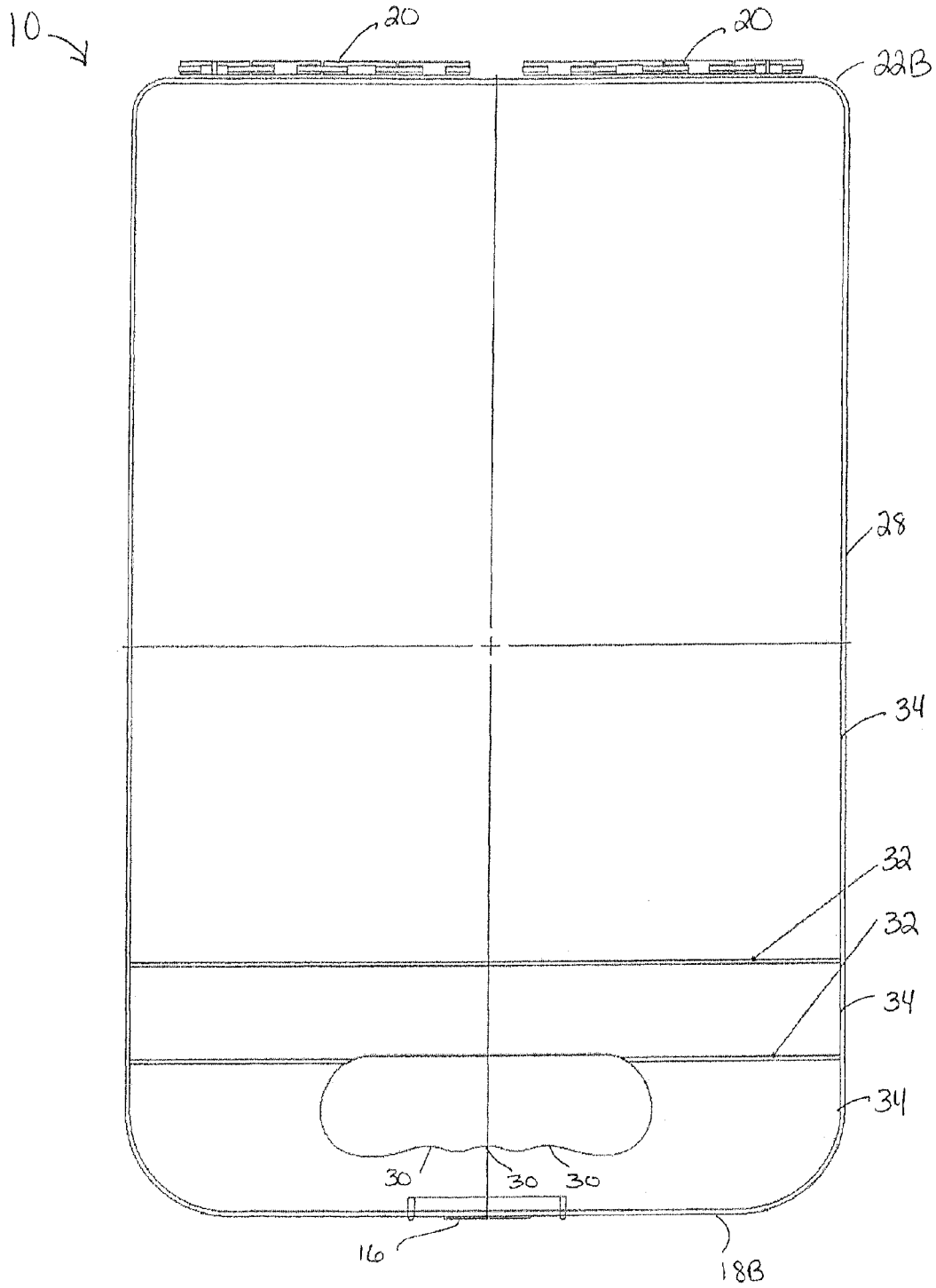
FIG. 2 is a top view of a bottom portion of the combined activity and storage case of FIG. 1, in accordance with the first exemplary embodiment of the present invention.

FIG. 2 is a top view of a bottom portion 28 of the combined activity and storage case 10 of FIG. 1, in accordance with the first exemplary embodiment of the present invention. The bottom portion 28 is attached to the hinge 20 at a back side 22B of the bottom portion 28, which allows the top portion 12 to open pivotably in relation to the bottom portion 28. The bottom portion 28 is attached to the clasp 16, which allows a front side 18B of the bottom portion 28 to be locked to the front side 18 of the top portion 12. When the clasp 16 is in a locked position, the clasp 16, in combination with the hinge 20, prevents the combined activity and storage case 10 from being opened, and the contents from spilling out.

The bottom portion 28 includes a bottom handle portion 14B, which substantially aligns with the handle 14 when the bottom portion 28 is substantially aligned with the top portion 12. The handle 14 and the bottom handle portion 14B may include three notches 30 to receive four fingers comfortably for carrying the combined activity and storage case 10. The handle 14 and bottom handle portion 14B may be as wide as five or more inches, to comfortably receive a hand of an adult. The handle 14 and bottom handle portion 14B may be as wide as four inches or narrower, to comfortably receive a hand of a child.

The bottom portion 28 preferably also includes one or more raised barriers 32. The raised barriers 32 serve two functions. For one, the barriers create compartments 34 within the combined activity and storage case 10, for organizing items stored within the case 10, and for preventing items from sliding out of the created compartments 34 when the storage case 10 is carried or otherwise jostled in a closed position. The created compartments 34 may exist between raised barriers 32 or between at least one raised barrier 32 and a side of the combined activity and storage case 10. The raised barriers 32 preferably extend to the inside wall of the top portion 12 when the combined activity and storage case 10 is in a closed position. The top portion 12 may also have raised barriers (not shown) that meet the raised barriers 32 of the bottom portion 28. The raised barriers also serve to stiffen the case.

Figure 3:
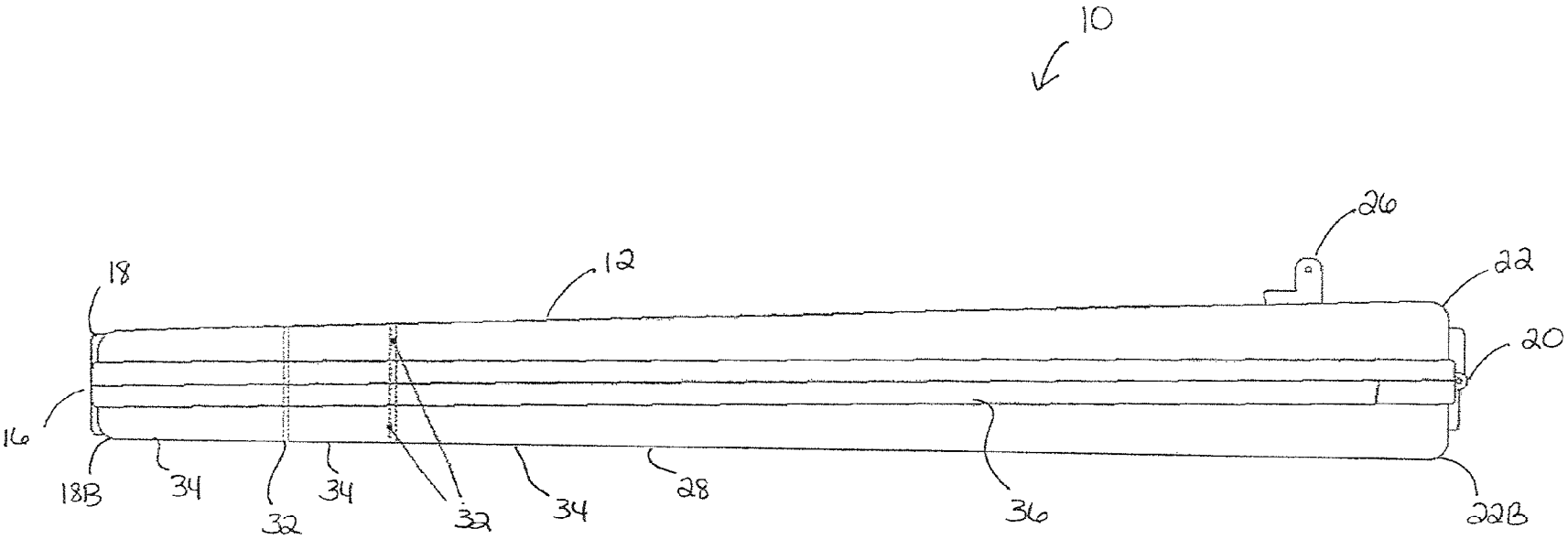
FIG. 3 is a side view of the combined activity and storage case of FIG. 1, in a closed position, in accordance with the first exemplary embodiment of the present invention.

FIG. 3 is a side view of the combined activity and storage case 10 of FIG. 1, in a closed position, in accordance with the first exemplary embodiment of the present invention. FIG. 3 shows the clip bracket 26 mounted to the top portion 12, although the stylized clip 24 is not shown. The top portion 12 is attached to the bottom portion 28 at the hinge 20, located at the back side 22 of the top portion 12 and the back side 22B of the bottom portion 28. The clasp 16 locks the front side 18 of the top portion 12 to the front side 18B of the bottom portion 28. At least one raised barrier 32 runs between the top portion 12 and the bottom portion 28 to create the compartments 34. A lip 36 preferably is provided along a perimeter of either the top portion 12 or the bottom portion 28, overlapping the edge of the other portion when the combined activity and storage case 10 is in a closed position. The lip 36 may cover minor gaps that might otherwise exist between the top portion 12 and the bottom portion 28 when the combined activity and storage case 10 is in a closed position, and also serves to stiffen the case.

Figure 4:
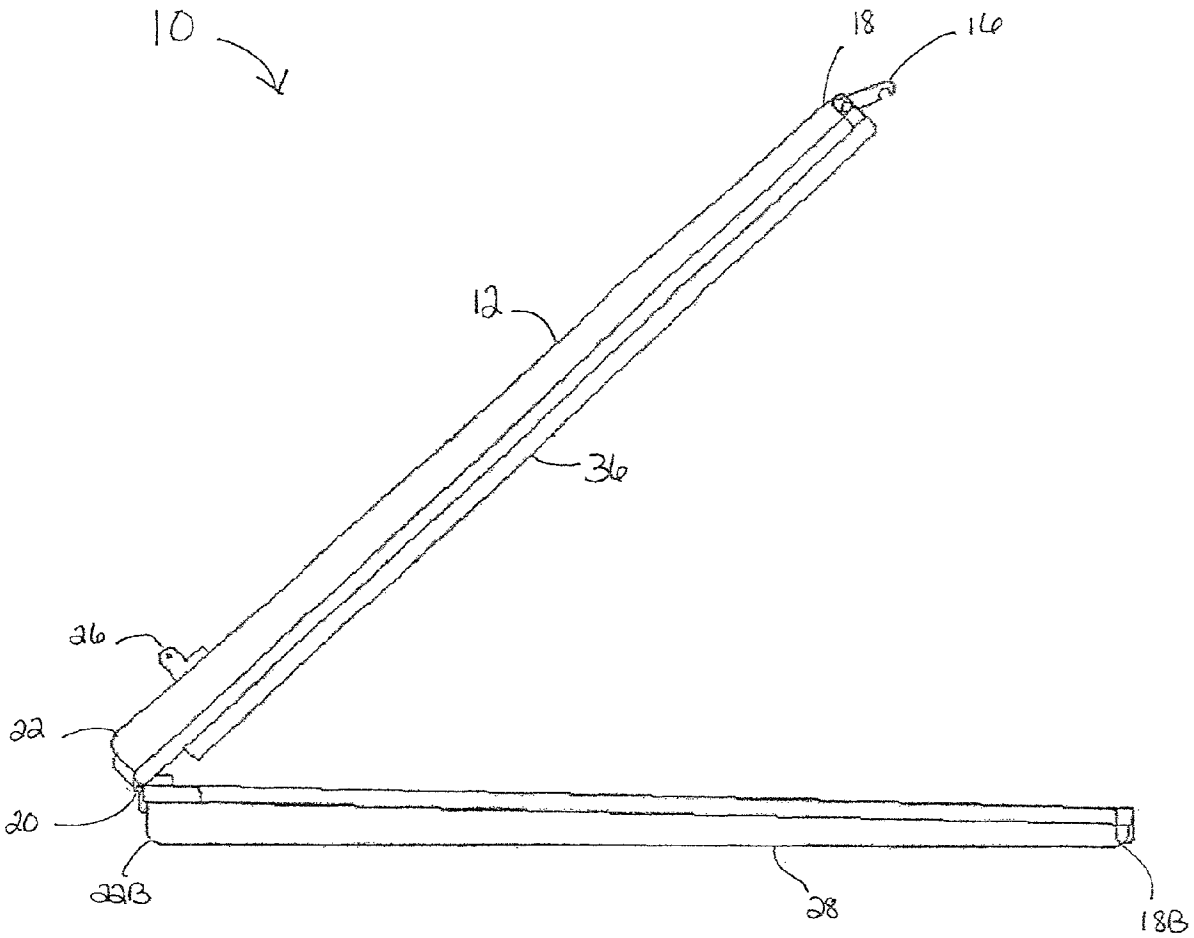
FIG. 4 is a side view of the combined activity and storage case of FIG. 1, in an opened position, in accordance with the first exemplary embodiment of the present invention.

FIG. 4 is a side view of the combined activity and storage case 10 of FIG. 1, in an opened position, in accordance with the first exemplary embodiment of the present invention. FIG. 4 shows the clip bracket 26 mounted to the top portion 12, although the stylized clip 24 is not shown. The top portion 12 is attached to the bottom portion 28 at the hinge 20, located at the back side 22 of the top portion 12 and the back side 22B of the bottom portion 28. The clasp 16 locks the front side 18 of the top portion 12 to the front side 18B of the bottom portion 28.

Figure 4A:
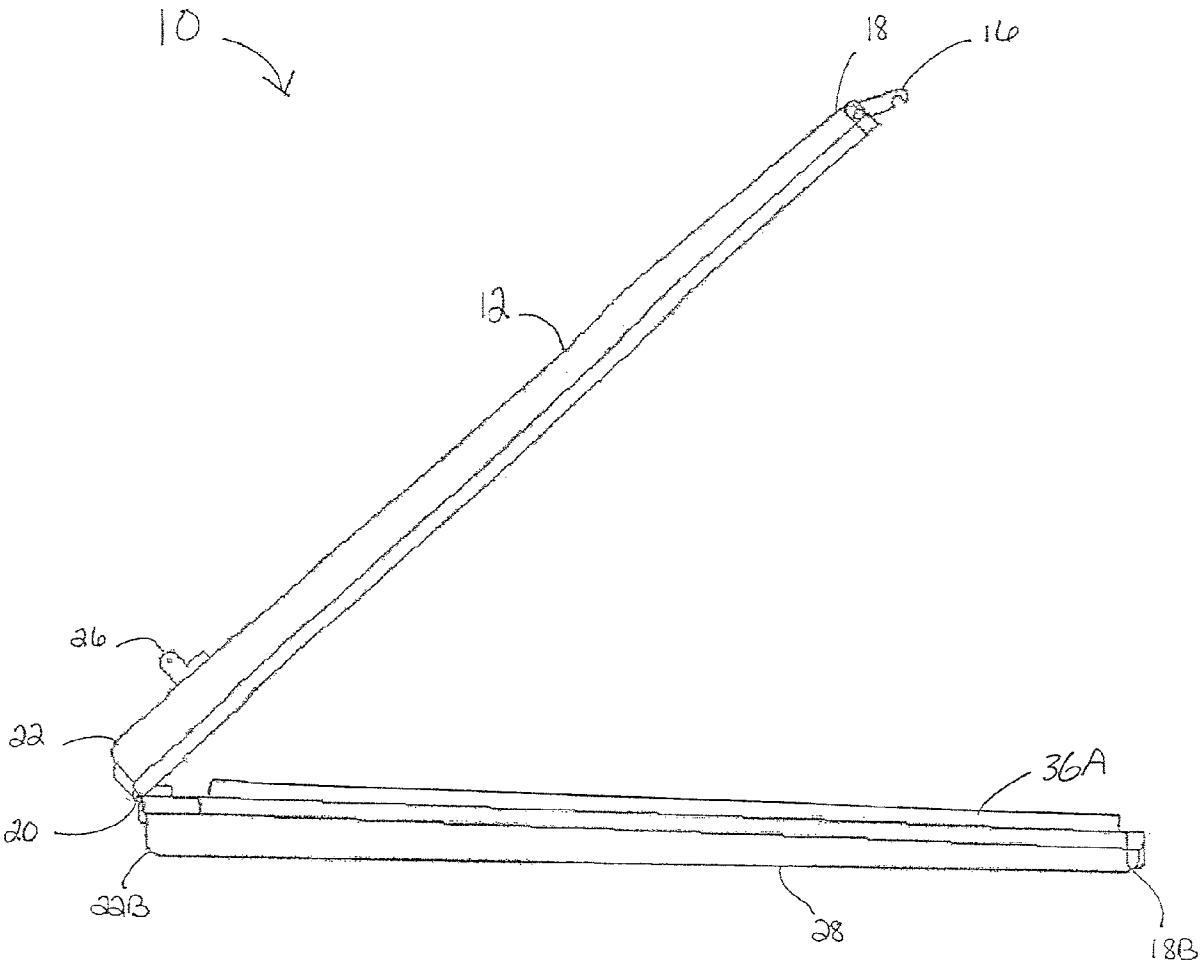
FIG.4A is a view, similar to FIG. 4, showing an alternative embodiment of the present invention.

Alternatively, as shown in FIG. 4A, a lip 36A may be provided along a perimeter of the bottom portion 28, and overlapping the edge of the top portion 12 when the combined activity and storage case 10 is in a closed position.

Figure 5:
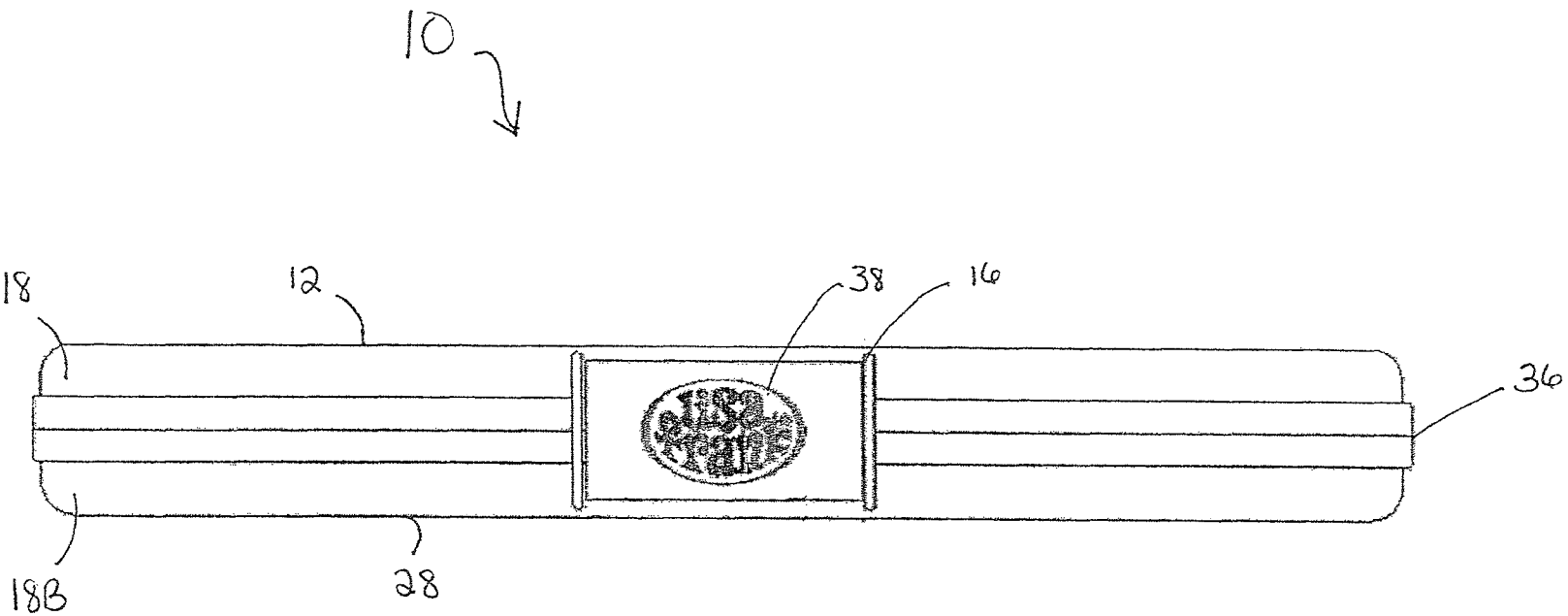
FIG. 5 is a front view of the combined activity and storage case of FIG. 1, in a closed position, in accordance with the first exemplary embodiment of the present invention.

FIG. 5 is a front view of the combined activity and storage case 10 of FIG. 1, in a closed position, in accordance with the first exemplary embodiment of the present invention. The clasp 16 locks the front side 18 of the top portion 12 to the front side 18B of the bottom portion 28. The clasp 16 may feature a two-dimensional design 38 or the design 38 may be raised or the clasp 16 may be stylized, in a manner similar to the stylized clip 24.

Figure 6:
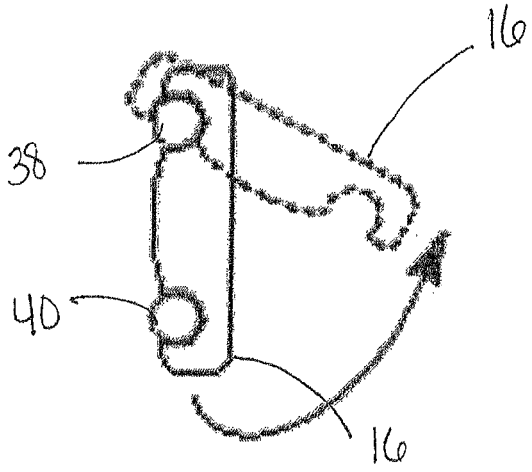
FIG. 6 is a cross-sectional view of a clasp of the combined activity and storage case of FIG. 1, in accordance with the first exemplary embodiment of the present invention.

FIG. 6 is a cross-sectional view of the clasp 16 of the combined activity and storage case 10 of FIG. 1, in a closed position, in accordance with the first exemplary embodiment of the present invention. FIG. 6 also shows the clasp 16 in an opened position using phantom lines. The clasp 16 is connected to the storage case 10 by a top hinge pin 40, upon which the clasp 16 pivots. The top hinge pin 38 is connected to the top portion 12 of the combined activity and storage case 10 at the front side 18 of the top portion 12. When moved into a locked position, the clasp 16 latches onto a bottom latch pin 40. The bottom latch pin 40 is connected to the bottom portion 28 of the storage case 10 at the front side 18B of the bottom portion 28.

Figure 7:
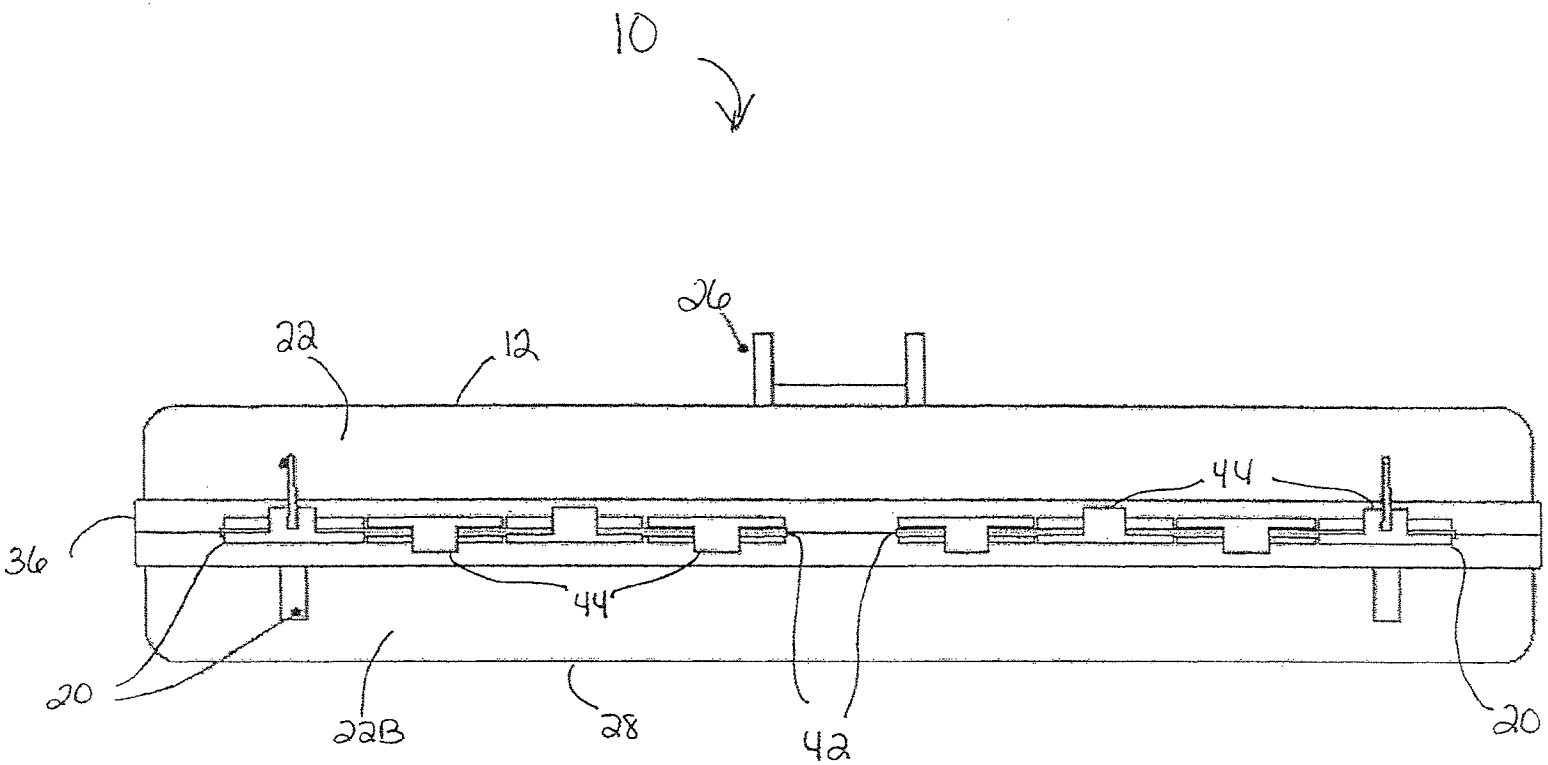
FIG. 7 is a back view of the combined activity and storage case of FIG. 1, in a closed position, in accordance with the first exemplary embodiment of the present invention.

FIG. 7 is a back view of the combined activity and storage case 10 of FIG. 1, in a closed position, in accordance with the first exemplary embodiment of the present invention. The back view shows the top portion 12 attached to the bottom portion 28 by two hinges 20. The hinges 20 include back hinge pins 42. The back hinge pins 42 are held within hinge slots 44, which are attached to both the back side 22 of the top portion 12 and the back side 22B of the bottom portion 28. FIG. 7 also shows the clip bracket 26 mounted to the top portion 12, although the stylized clip 24 is not shown.

Figure 8:
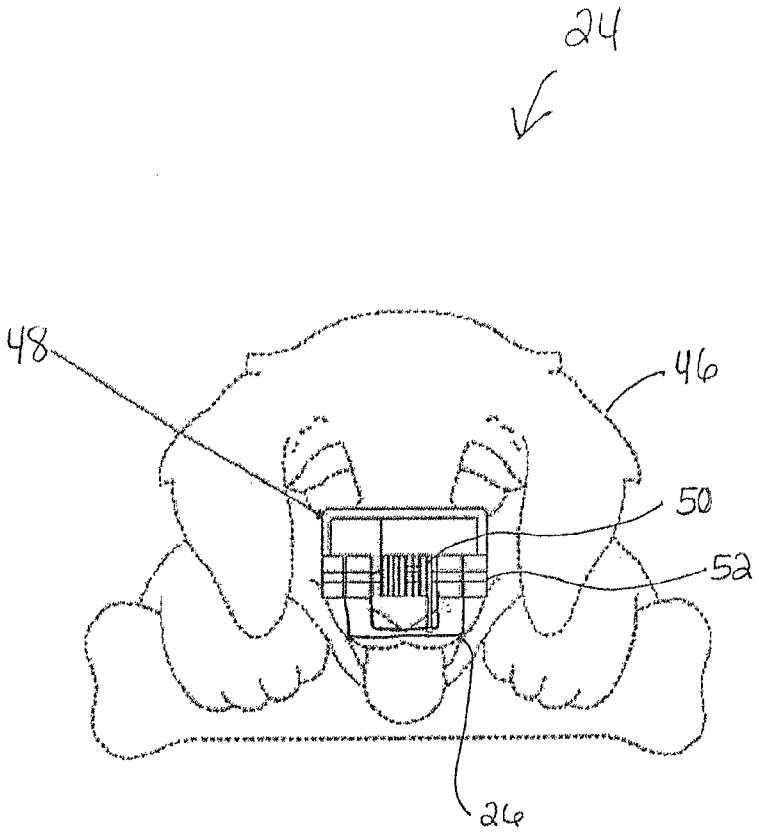
FIG. 8 is an underside view of the stylized clip of the combined activity and storage case of FIG. 1, in accordance with the first exemplary embodiment of the present invention.

FIG. 8 is an underside view of the stylized clip 24 of the combined activity and storage case 10 of FIG. 1, in accordance with the first exemplary embodiment of the present invention. The stylized clip 24 includes a stylized article 46 attached to a clip mount 48. The clip mount 48 is attached to the clip bracket 26 by a clip hinge 52. The clip bracket 26 as shown, for example, in FIG. 1, is attached to the back side 22 of the top portion 12 of the storage case 10. The stylized clip 24 is held in a fastening position by a spring 50 enveloping the clip hinge 52 and biased against both the stylized clip 24 and the top portion 12.

Figure 9:
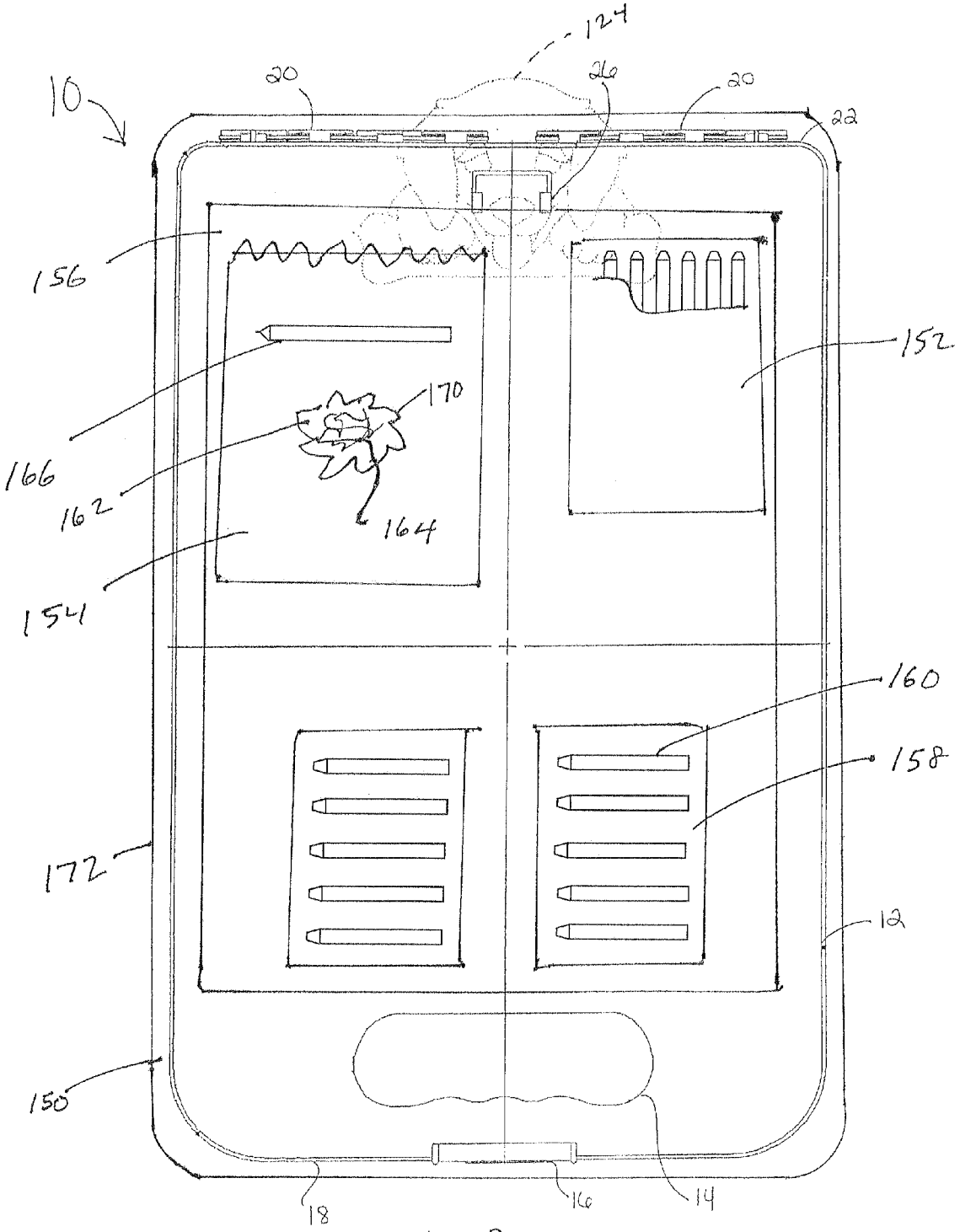
FIG. 9 is a top view of a combined activity, and storage case, in accordance with the present invention, packaged in a display for sale.

FIG. 9 is a top view of a combined activity and storage case 10 of the present invention, packaged for sale. As shown in FIG. 9, the combined activity and storage case 10 is packaged within a molded translucent plastic cover 150 that includes a plurality of 1 contours for accommodating and displaying a plurality of items or contents. For example, as shown in FIG. 9, the plurality of items may include a box of crayons 152, a 3"×5" notebook 154, an 8½×11" notebook 156, an open container 158 of markers 160, a plurality of stickers 162, and a pen 166. The plastic cover 150 should be contoured to keep the plurality of items separated from one another within the plastic cover 150. If desired the plastic cover 150 also may be molded with fanciful shapes to store certain items. By way of example, a necklace 164 may be stored in a molded star shape 170 within the plastic cover 150. The back of the plastic cover 150 (not shown) should be shaped to closely conform to the back of the case, and the top and back of the plastic cover may be molded to meet at the handle 14, and joined to one another at a perimeter 172 of the covers. The 8½"×11" notebook 156 may be held in position beneath the stylized clip 124.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

What is claimed is:

1. A packaged combined activity and storage case assembly comprising:

a top portion having a front side and a back side;

a bottom portion having a front side and a back side, the back side of the bottom portion connected to the back side of the top portion by at least one hinge, wherein the top portion and the bottom portion form an interior space when in a closed position, the interior space having at least one raised barrier extending from the bottom portion and located within the interior space, for dividing the interior space into a plurality of compartments, and for stiffening the case;

a handle formed in the top portion and the bottom portion, the handle being shaped to receive four fingers;

a clasp positioned to latch the front side of the top portion to the front side of the bottom portion;

a stylized clip having a character shape and appearance attached to the top portion;

a substantially translucent display packaging separate from and surrounding the combined activity and storage case; and a plurality of items held between the substantially translucent display packaging and the top portion, wherein the plurality of items are sized to fit under the display packaging, and wherein the display packaging is contoured to keep the plurality of items separated from each other within the display packaging.

2. The packaged combined activity and storage case assembly of claim 1, further comprising a top hinge pin mounted to the front side of the top portion and a bottom latch pin mounted to the front side of the bottom portion, wherein the clasp is rotatably mounted to the top hinge pin and interlockable with the bottom latch pin.

3. The packaged combined activity and storage case assembly of claim 1, wherein the substantially translucent display packaging has a shape similar to the exterior of the top portion and the bottom portion.

4. The packaged combined activity and storage case assembly of claim 1, wherein the substantially translucent display packaging is shaped to conform to the bottom portion, and to accommodate said plurality of items on the top portion.

5. The packaged combined activity and storage case assembly of claim 4, further comprising at least one plastic divider positioned to hold at least one of the plurality of items in a stationary position between the top portion and the substantially translucent packaging.

6. The packaged combined activity and storage case assembly of claim 1, further comprising at least one plastic divider positioned to hold at least one of the plurality of items in a stationary position between the top portion and the substantially translucent packaging.

7. The packaged combined activity and storage case assembly of claim 1, further comprising a handle portion in the top portion and the bottom portion sized to conform to a hand of a child.

8. The packaged combined activity and storage case assembly of claim 1, wherein the top portion has a lip extending from its perimeter to overlap at least in part a perimeter of the bottom portion when the top portion and the bottom portion are in a closed position.

9. The packaged combined activity and storage case assembly of claim 1, wherein the bottom portion has a lip extending from its perimeter to overlap at least in part a perimeter of the top portion when the top portion and the bottom portion are in a closed position.

10. The packaged combined activity and storage case assembly of claim 1, wherein the stylized clip comprises a spring-biased clip.

11. A packaged combined activity and storage case assembly comprising:

a top portion having a front side and a back side;

a bottom portion having a front side and a back side, the back side of the bottom portion connected to the back side of the top portion by at least one hinge, wherein the top portion and the bottom portion form an interior space when in a closed position, the interior space having at least one raised barrier extending from the bottom portion and located within the interior space, for dividing the interior space into a plurality of compartments, and for stiffening the case;

a handle formed in the top portion and the bottom portion, the handle shaped to receive four fingers;

a clasp positioned to latch the front side of the top portion to the front side of the bottom portion;

a clip attached to a clip mount attached to the top portion, said clip mount having a spring that holds the clip in a fastening position;

a substantially translucent display packaging separate from and surrounding the combined activity and storage ease; and a plurality of items held between the substantially translucent display packaging and the top portion, wherein the plurality of items are sized to fit under the display packaging, and wherein the display packaging is contoured to keep the plurality of items separated from each other within the display packaging.

12. The packaged combined activity and storage case assembly of claim 11, wherein the clip is a stylized clip comprised of a stylized article that has a character shape and appearance.

13. The packaged combined activity and storage case assembly of claim 11, wherein the clip comprises a spring-biased clip.

* * * * *

UNITED STATES PATENT AND TRADEMARK OFFICE

CERTIFICATE OF CORRECTION

PATENT NO. : 8,678,217 B2
APPLICATION NO. : 11/193209
DATED : March 25, 2014
INVENTOR(S) : Green It is certified that error appears in the above-identified patent and that said Letters Patent is hereby corrected as shown below:

In the Claims

Claim 11, Col. 6, line 40-41 “storage ease; and” should be --storage case; and--

Signed and Sealed this
Twenty-sixth Day of August, 2014

Michelle K. Lee

Michelle K. Lee
*Deputy Director of the United States Patent and Trademark Office*